United States Patent [19]

Pace

[11] 4,206,663

[45] Jun. 10, 1980

[54] LINEMAN SNAKE GRIPPER

[76] Inventor: Joseph Pace, 303 99th St., Brooklyn, N.Y. 11209

[21] Appl. No.: 851,168

[22] Filed: Nov. 14, 1977

Related U.S. Application Data

[63] Continuation-in-part of Ser. No. 693,745, Jun. 8, 1976, abandoned.

[51] Int. Cl.[2] ..... B25B 7/02

[52] U.S. Cl. ..... 81/311; 81/3 J; 81/418; 7/125

[58] Field of Search ..... 81/5.1 R, 305, 303, 81/3 J, 304, 418, 307, 425 R, 311, 425 A; 7/3 R

[56] References Cited

U.S. PATENT DOCUMENTS

| | | | |
|---|---|---|---|
| 720,974 | 2/1903 | Schooley | 81/311 |
| 1,066,071 | 7/1913 | Beanes | 81/311 |
| 2,598,146 | 5/1952 | Tays | 81/5.1 R |
| 3,005,366 | 10/1961 | Grimshaw et al. | 81/5.1 R |

FOREIGN PATENT DOCUMENTS

| | | | |
|---|---|---|---|
| 658069 | 10/1951 | United Kingdom | 81/305 |

*Primary Examiner*—Nicholas P. Godici
*Assistant Examiner*—Roscoe V. Parker

[57] ABSTRACT

A lineman's pliers which is designed to push or pull a snake through a conduit or tubing with less effort and time due to the provision of special gripping and alignment means that do not crimp the snake and apply more effective gripping action. The pliers include a pair of crossed levers provided with a head at one end having front and rear pairs of opposing jaws and opposing elongated handles at the other end whereby said jaws may be operated to effectively grip a snake.

2 Claims, 3 Drawing Figures

LINEMAN SNAKE GRIPPER

This application is a continuation in part of Ser. No. 693,745 filed on 6-08-76 and now abandoned.

This invention relates generally to pliers used by electricians in feeding or pulling metal snakes through conduit tubing and is provided with structure to perform multiple functions.

It is generally well known to those who are skilled in this particular field that when feeding a metal snake into a conduit or tubing, upon occassion the electrician may have difficulty in getting the snake around a 90 degree bend, making it necessary to force the snake into the conduit or tubing by employing pliers with the pliers jaws grasping the snake while pushing the snake with the pliers. This means that extreme pressure must be applied by the workman's hands on the pliers handles. After the snake meets the end of the conduit or tubing, a wire is then affixed to the snake and is pulled into the raceway. Upon the wire reaching the 90 degree bend, difficulty is encountered likewise, making it hard to pull the snake ahead, which means that the electrician must again use the pliers and exert great physical pressure on the pliers handles grapsed in his hands in order to move the same ahead. This is painful labor for the hands and timing consuming, so that the situation is objectionable and is therefore in want of an improvement.

Accordingly, it is a principal object of the present invention to provide a snake gripper that overcomes the above undesirable situation, wherein the pliers are specially constructed to more effectively grip the snake without any crimping action.

Another object is to provide a snake gripper which accordingly is much safer to use because by using less effort the electrician's hand would not be jabbed into the conduit end with the conventional hard force in case the pliers jaws accidentally slip off the snake, so that the hands are thus safer from injury, also allowing the job to be done in less time and reducing labor costs. It is also well known that upon occassion an electrician is obliged to skin an insulated number 12 guage wire by using a specially designed skinner, a knife and finally by using the cutter of the pliers which of course risks the possibility of nicking the wire, which is likewise an undesirable situation. Accordingly, still another object of the present invention is to provide a lineman snake gripper having a skinner opening incorporated between the plier jaws, and which is designed for the particular wire; and which thus eliminates the need to carry an extra skinner and knife.

Other objects are to provide a lineman plier which is simple in design, inexpensive to manufacture, rugged in construction, easy to use and efficient in operation.

These and other objects will be readily evident upon a study of the following specifications and the accompanying drawing wherein.

Figure 1:
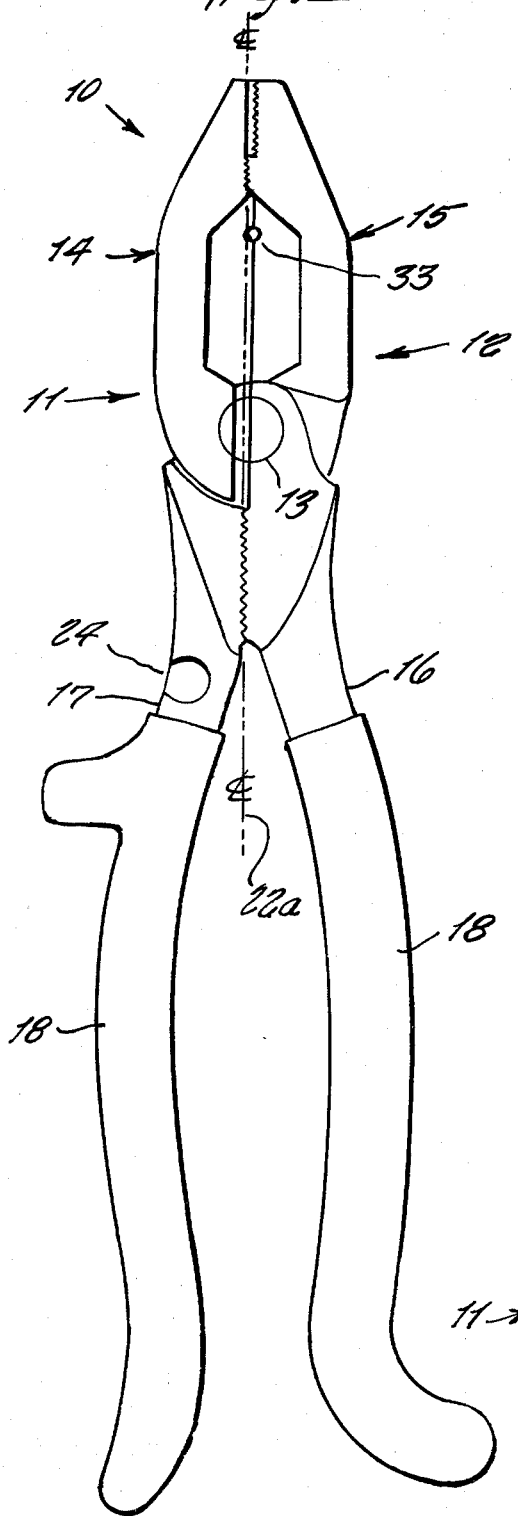
FIG. 1 is a side view of the invention.

Reference is now made to the drawing in greater detail wherein the reference number 10 represents a lineman snake gripper according to the present invention.

The snake gripper is comprised of a pair of levers 11 and 12 pivotally attached together by a pivot pin 13 transversely mounted through relatively movable engaging portions of the levers so as to form a pair of mating jaws 14 and 15 respectively at one end, and a pair of reversely curved non-slip handles 16 and 17 at a opposite end for being grasped by a persons hand, and which are covered by insulation 18 so to not transmit any electric shock to a persons hand holding the same in case the jaws engage a live wire or other electrically charged object. The pin 13 is integral or securely affixed to lever 11 and is pivotally mounted through lever 12.

In the present invention, checkered or toothed faces 19 and 20 of the jaws engage each other when the pliers is fully closed, and which are used for grasping various objects firmly therebetween.

Figure 2:
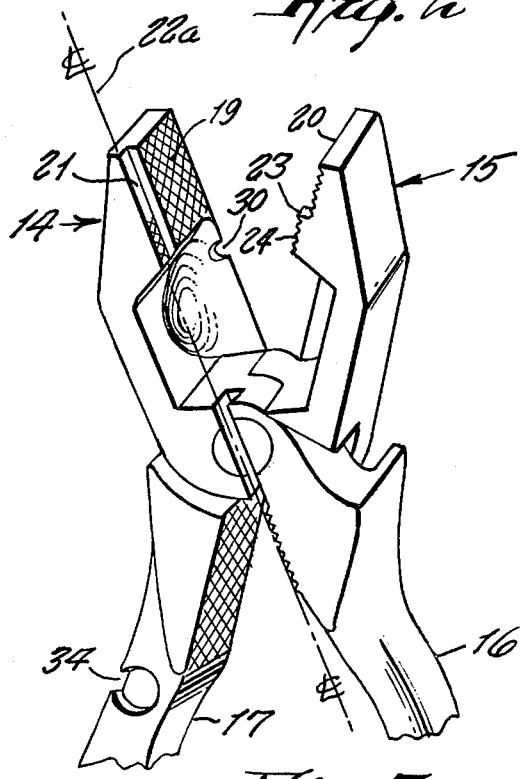
FIG. 2 is a perspective view of the jaws thereof shown spread opened.

A longitudinal groove 21 along one side edge of jaw 14 serves to receive a snake which in FIGS. 1 and 2 is shown to have a stepped surface aligned with longitudinal center line 22*a*. A tooth 23 on the jaw 15 projects forwardly of face 20 and has a checkered or toothed forward side 24 that engages the stepped checkered or toothed surface 25 of groove 21 to provide a more effective gripping action.

Figure 3:
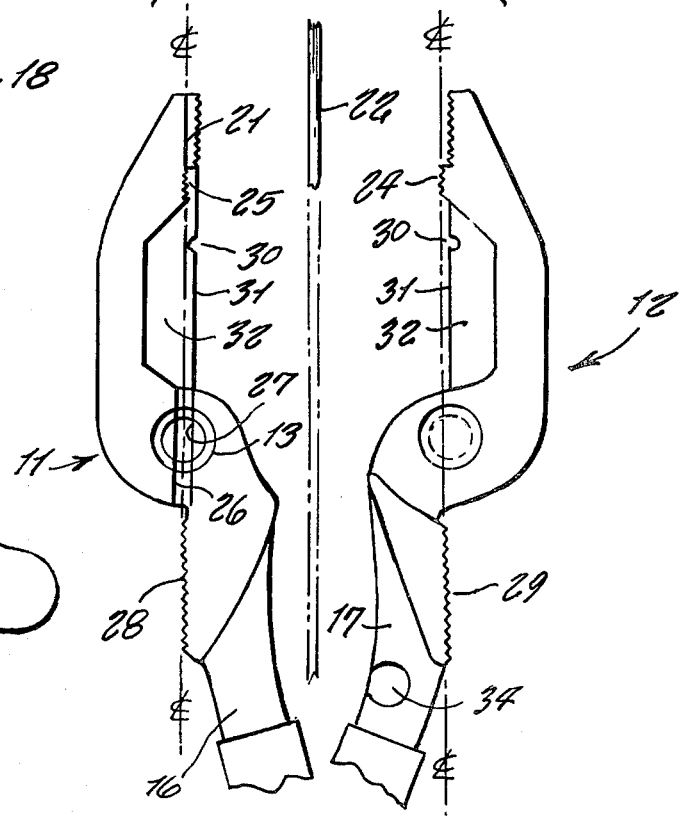
FIG. 3 is a side view of the plier levers shown disassembled from each other and spaced apart so to more clearly see the jaw contour of each.

The lever 11 has a groove 26 (see FIG. 3) on one side 27 of jaw 14 which aligns axially with surface 25.

A checkered or toothed face 28 is formed on lever 11 and is located on the handle portion 16. The lever 12 has a corresponding checkered or tooth face 29 that engages the face 28. As shown in the drawings the faces 28 and 29 when engaged are axially aligned with surface 25, center line 22*a* and groove 26 thereby providing longitudinal aligning and gripping surfaces for the snake.

It will now be therefore evident that operative use when a snake is thus grapsed between faces 24 and 25 on one side of the pivot pin 13, and between faces 28 and 29 on an opposite side of the pivot pin that the snake is more firmly held over a straight longer portion thereof, for either pulling or pulling action without crimping the snake.

A circular notch 30 along mating wire cutting edges 31 of a blade 32 on each jaw is provided to receive a particular number 12 guage wire for being skinned, the notches 30 together forming a circular opening 33 when the jaws are closed so to fit the specific size of the wire, commonly used by the electrician.

A notch 34 provided on the handle portion of lever 12 serves for bending wire into a loop, to be affixed on a screw.

It should be further noted that the reversely curved handles as seen in FIG. 1 provide firmer gripping surfaces for the users hands.

What is claimed is as follows:

1. A linemans pliers adapted for use as a snake gripper, comprising a pair of pivotably secured crossing levers having spaced outer transverse sides provided with a head having front and rear pairs of coacting opposing jaws with gripping surfaces at the front end of said levers and opposing elongated handles at the rear end, said jaws disposed between said sides including a pivot pin affixed to a first of said levers and pivotably mounted in the second of said levers at a point along the longitudinal axis of said pliers, between the front and rear jaws including an axial longitudinal groove along one of said outer transverse sides wherein the said front and rear gripping surfaces of said jaws align longitudinally with said groove centerline along the longitudinal axis of the pliers when said jaws are closed in the gripping position.

2. A linemans pliers as in claim 1, wherein one of said front jaws includes a front groove portion always aligned with the first said groove and a tooth projecting into said portion from the opposing jaw, wherein said gripping surfaces are serrated.

* * * * *